US006253797B1

(12) United States Patent
Vogel et al.

(10) Patent No.: US 6,253,797 B1
(45) Date of Patent: Jul. 3, 2001

(54) TERRY FABRIC WITH RELIEF EFFECT AND METHOD FOR ITS MANUFACTURE

(75) Inventors: Rudolf Vogel, Grüt; Martin Oeschger, Rüti, both of (CH)

(73) Assignee: Sulzer Rueti AG, Rueti (CH)

( * ) Notice: Subject to any disclaimer, the term of this patent is extended or adjusted under 35 U.S.C. 154(b) by 0 days.

(21) Appl. No.: 09/270,215

(22) Filed: Mar. 15, 1999

(30) Foreign Application Priority Data

Mar. 16, 1998 (EP) ..... 98810218

(51) Int. Cl.[7] ..... D03D 27/08; D03D 39/22
(52) U.S. Cl. ..... 139/396; 139/25
(58) Field of Search ..... 139/396, 25

(56) References Cited

U.S. PATENT DOCUMENTS

| | | | | |
|---|---|---|---|---|
| 1,830,892 | * | 11/1931 | Talbirt | 139/396 |
| 2,655,950 | * | 10/1953 | Mills | 139/396 |
| 3,302,665 | * | 2/1967 | McHargue | 139/396 |
| 4,034,634 | * | 7/1977 | Arbter | 83/18 |
| 5,447,182 | * | 9/1995 | Gehrig | 139/396 |

FOREIGN PATENT DOCUMENTS

| | | | |
|---|---|---|---|
| 2540376 | | 3/1977 | (DE) . |
| 0350446A1 | | 1/1990 | (EP) . |
| 0618319A1 | | 10/1994 | (EP) . |
| 1465855 | | 1/1967 | (FR) . |
| 3252 | | of 1910 | (GB) . |
| 426884 | | 4/1935 | (GB) . |
| 4-194055 | * | 7/1992 | (JP) . |
| 10-8350 | | 1/1998 | (JP) . |

OTHER PUBLICATIONS

Patent Abstracts of Japan, vol. 016, No. 518 (C–0999), Oct. 26, 1992 & JP 04 194055 A (Miyazaki Taoru KK), Jul. 14, 1992 Translated.

* cited by examiner

*Primary Examiner*—Andy Falik
(74) *Attorney, Agent, or Firm*—Townsend and Townsend and Crew LLP

(57) ABSTRACT

The terry fabric comprises a basic warp, weft threads and a pile warp or loop warp. The terry fabric is based on a float repeat or weft beat-up repeat, which includes a first and a second weft group. Whereas the first weft group in each case contains partially beaten up wefts, the second weft group contains in each case one fully beaten up weft or additionally a smooth weft.

18 Claims, 10 Drawing Sheets

TERRY FABRIC WITH RELIEF EFFECT AND METHOD FOR ITS MANUFACTURE

BACKGROUND OF THE INVENTION

Terry fabric with relief effect and method for its manufacture

The invention relates to a terry fabric relief effect in the fabric and to a method for its manufacture.

The terry fabrics consist, in known manner, of a basic warp, of weft threads and of a loop forming pile warp interwoven therewith. Terry fabrics are, as a rule, manufactured as three-weft or four-weft fabrics, with a float repeat forming the basis.

Reference is made to FIG. 1. For the three-weft fabric the float repeat comprises three wefts, with the wefts 1 and 2 being partially beaten up wefts and remaining, after having been woven in, at a partial beat-up distance VD from the cloth edge, and with the weft 3 forming a fully beat, up weft, which is beaten up together with the partly beaten up wefts 1 and 2 against the cloth edge. These three wefts are termed a weft group A or B. For a four-weft fabric, the float repeat comprises three partly beaten up wefts and one fully beaten up weft.

A method of forming loops for a double-sided terry fabric is described in JP-04194055. The fabric is based on a float repeat of six wefts, which are subdivided into two weft groups. The first weft group comprises three partly beaten up wefts which remain, after having been woven in, at a distance from the cloth edge, and the second weft group comprises two partly beaten up wefts and one fully beaten up weft, which is jointly beaten up with all the partly beaten up wefts against the cloth edge. The basic warp is bound off (or tied off) after the fifth and sixth weft and the pile warp is bound off around the second and/or fifth weft.

It has been proved to be a disadvantage in this terry fabric that the basic warp is only bound off after the fifth and sixth weft. A poor appearance of the fabric in the high pile and in irregular loops arises with rapidly running weaving machines in particular,.

SUMMARY OF THE INVENTION

It is an object of the invention, to improve of improving a terry fabric.

The advantages which can be achieved with the invention are essentially to be seen in the fact that the terry fabric has uniform loops and clean contour edges of the pattern, which give the fabric an improved relief effect, and in that better binding off is achieved on change of pile direction.

The invention will be explained in the following with reference to the accompanying drawings. There are shown:

DESCRIPTION OF THE PREFERRED EMBODIMENTS

Figure 1:
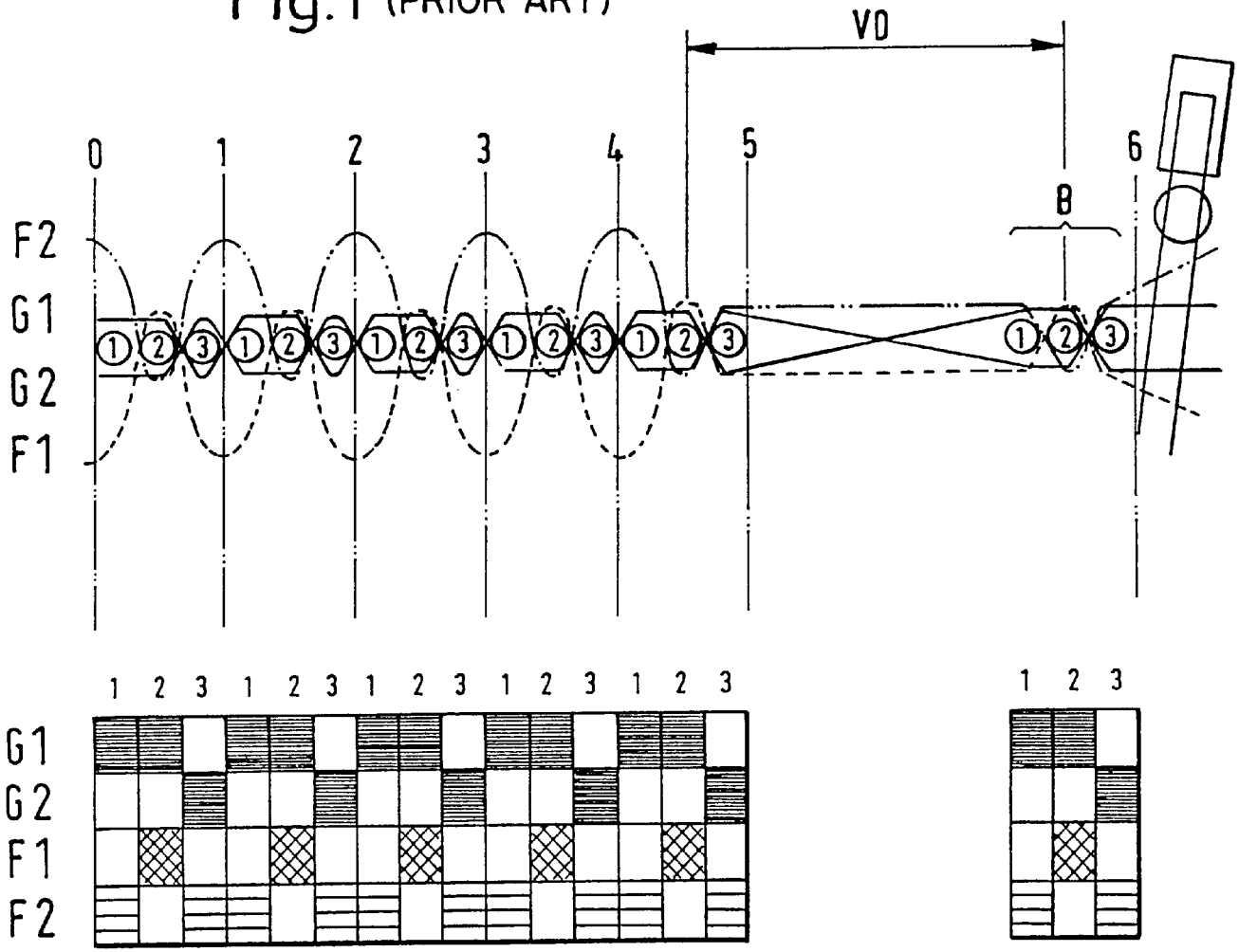
Fig.1 (PRIOR ART)
FIG. 1 is a fabric section of a known terry fabric and the float repeat for the fabric.
Figure 2A:
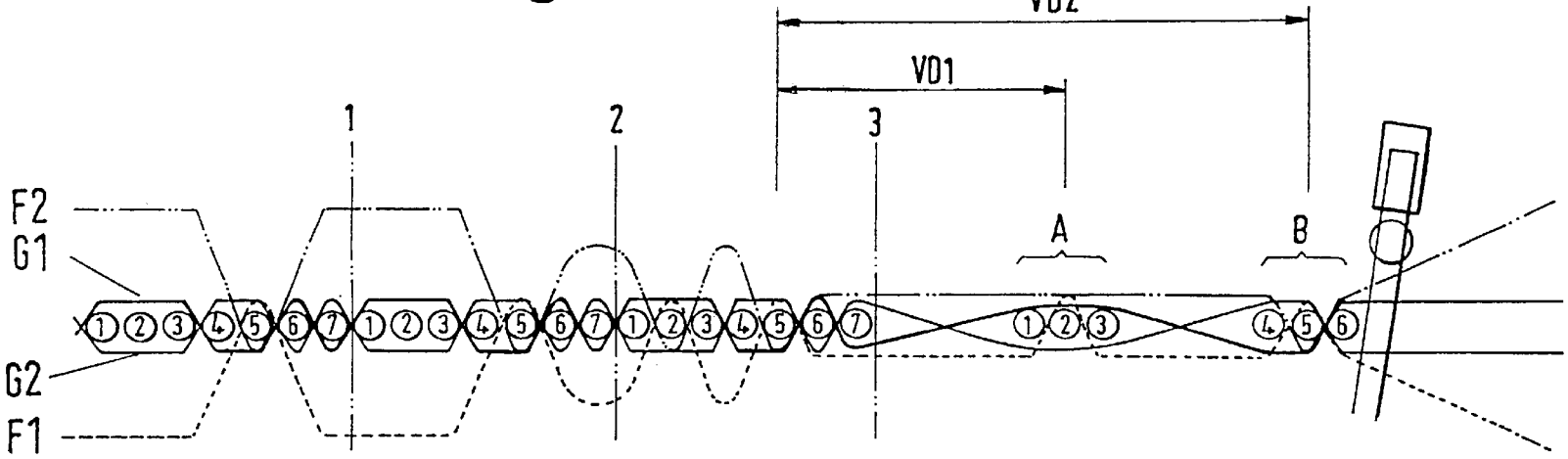
FIGS. 2*a,b,c* are fabric sections of a preferred embodiment of a fabric in accordance with the invention, from which the formation of the loops can be seen.

Reference is made to FIGS. 2*a,b,c* and 3. FIGS. 2*a,b,c* represent a procedure during weaving of a preferred embodiment of a terry fabric in accordance with the invention. The fabric comprises basic warp threads G1 and G2, weft threads and also pile warp threads F1 and F2 which, for example, have different colors. The fabric is a double-sided terry fabric with different loops at both sides, without binding change, i.e. the pile warp threads are either bound in at the top or at the bottom. The fabric is a so-called seven-weft terry fabric, i.e. a fabric which is based on a float repeat consisting of seven wefts and a weft beat-up repeat, with the weft beat-up repeat defining the weft groups, the nature of the beat-up (partial beat-up and full beat-up), and the beat-up distance, i.e. the distance of the weft group from the cloth edge and of the wefts relative to one another.

Figure 2B:
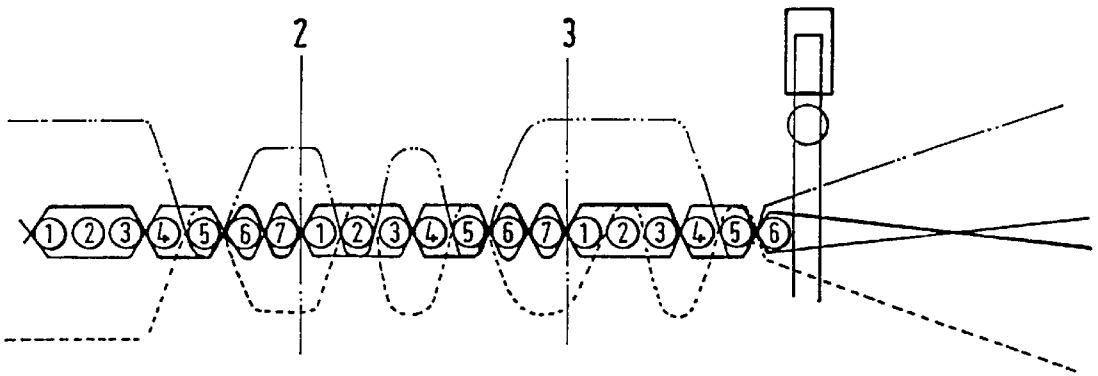
Figure 2C:
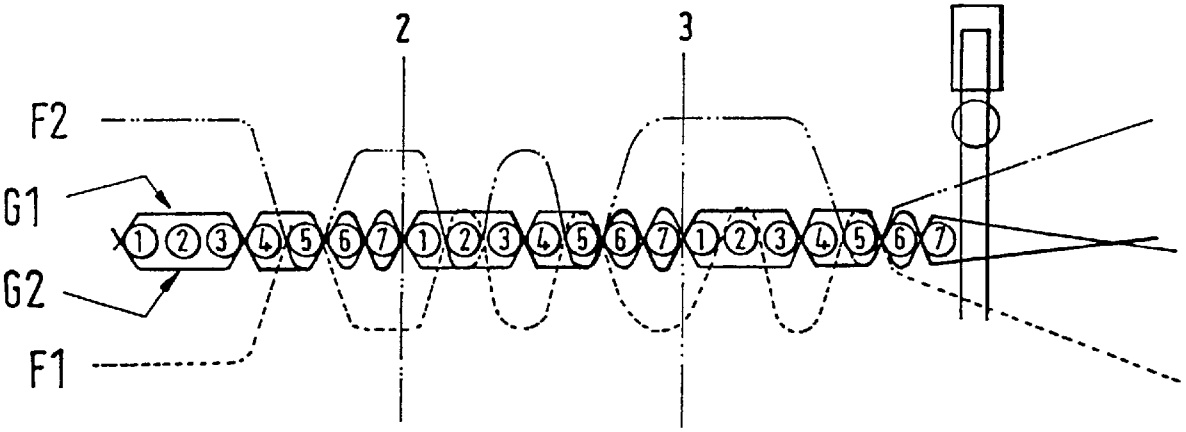

FIG. 2*a* shows the situation of the weaving process in which a first weft group A consisting of three partially beaten up wefts 1, 2, 3, which is woven in at the beat-up distance VD1, and a second weft group B, consisting of two partially beaten up wefts 4, 5 and one fully beaten up weft 6, which is woven in at the partial beat-up distance VD2, are available for the beat-up against the cloth edge. FIG. 2*b* shows the situation after the beating up of the two weft groups A and B. Thereafter, an additional fully beaten up weft 7 is inserted and beaten up. FIG. 2*c* shows the situation after the beating up of the additional fully beaten up weft 7.

Figure 3:
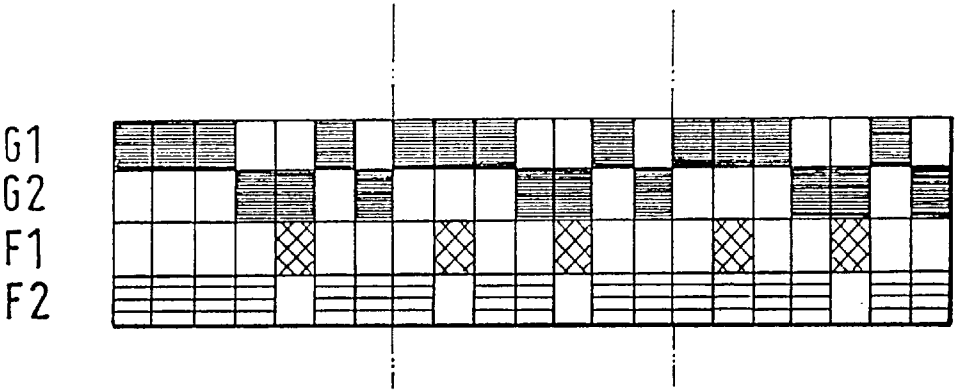
FIG. 3 is a float repeat with seven wefts for the fabric in accordance with FIG. 2*c*.

The float repeat for the above described seven-weft terry fabric is shown in FIG. 3.

Figure 4:
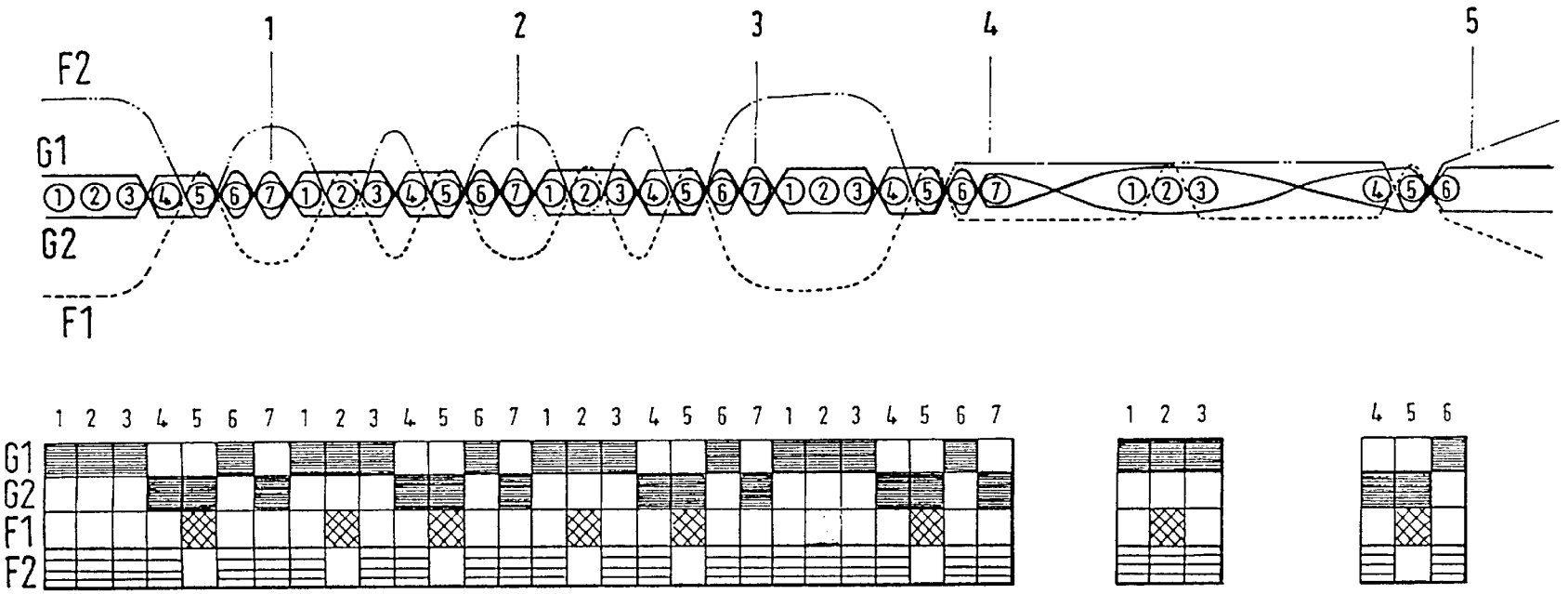
FIG. 4 is a section of the fabric of FIG. 2*a*, with a different pile pattern and the float repeat for the fabric.

FIG. 4 shows a seven-weft terry fabric with a different pile pattern, so that an extensive description of the same will be dispensed with.

Figure 5:
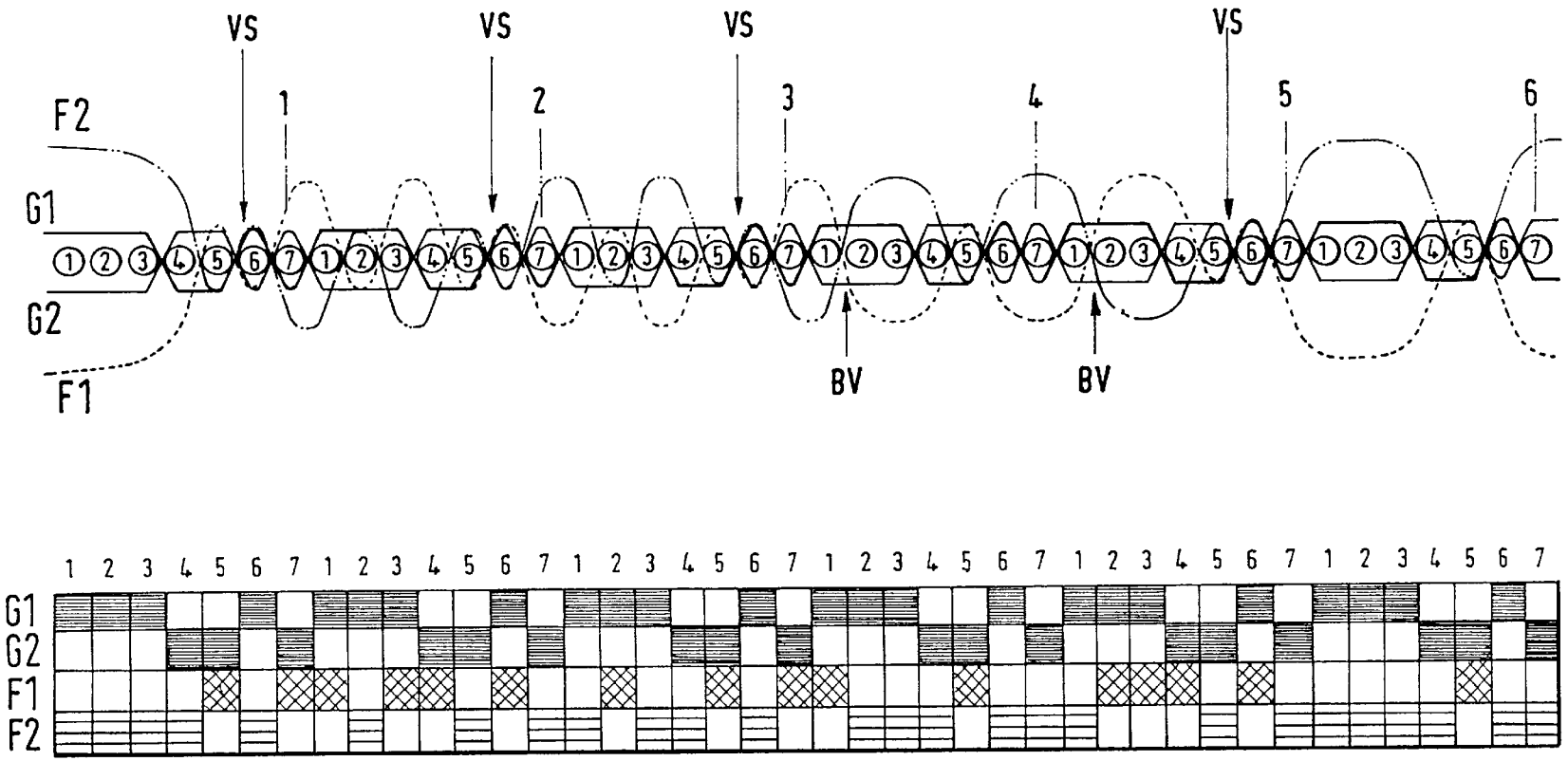
FIG. 5 is a fabric section of the in accordance with FIG. 2*a* with a further pile pattern and with pile binding changes and the float repeat for the fabric.
Figure 6:
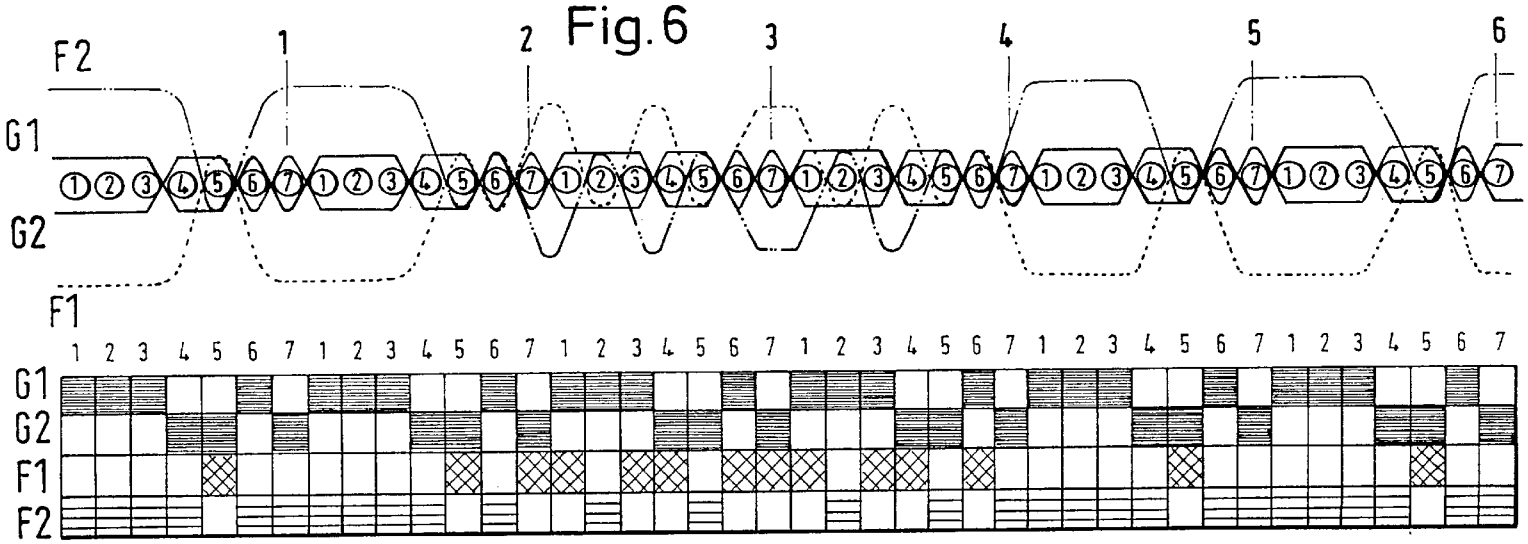
FIG. 6 is a fabric section of the fabric in accordance with FIG. 2*a*, with a third pile pattern and the float repeat for the fabric.
Figure 7A:
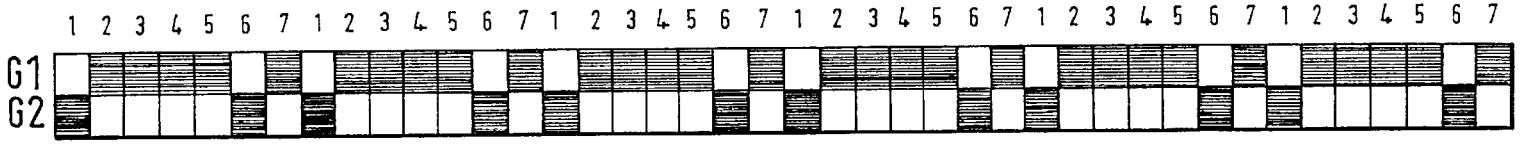
FIGS. 7*a* and 7*b* are embodiments of basic float repeats for a seven-weft terry fabric of FIGS. 2 to 6 and 8.
Figure 7B:
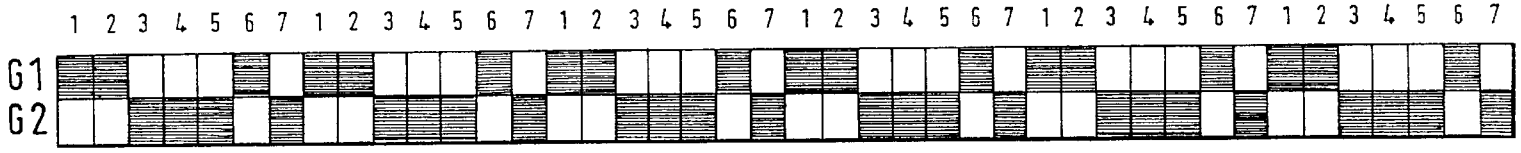
Figure 8:
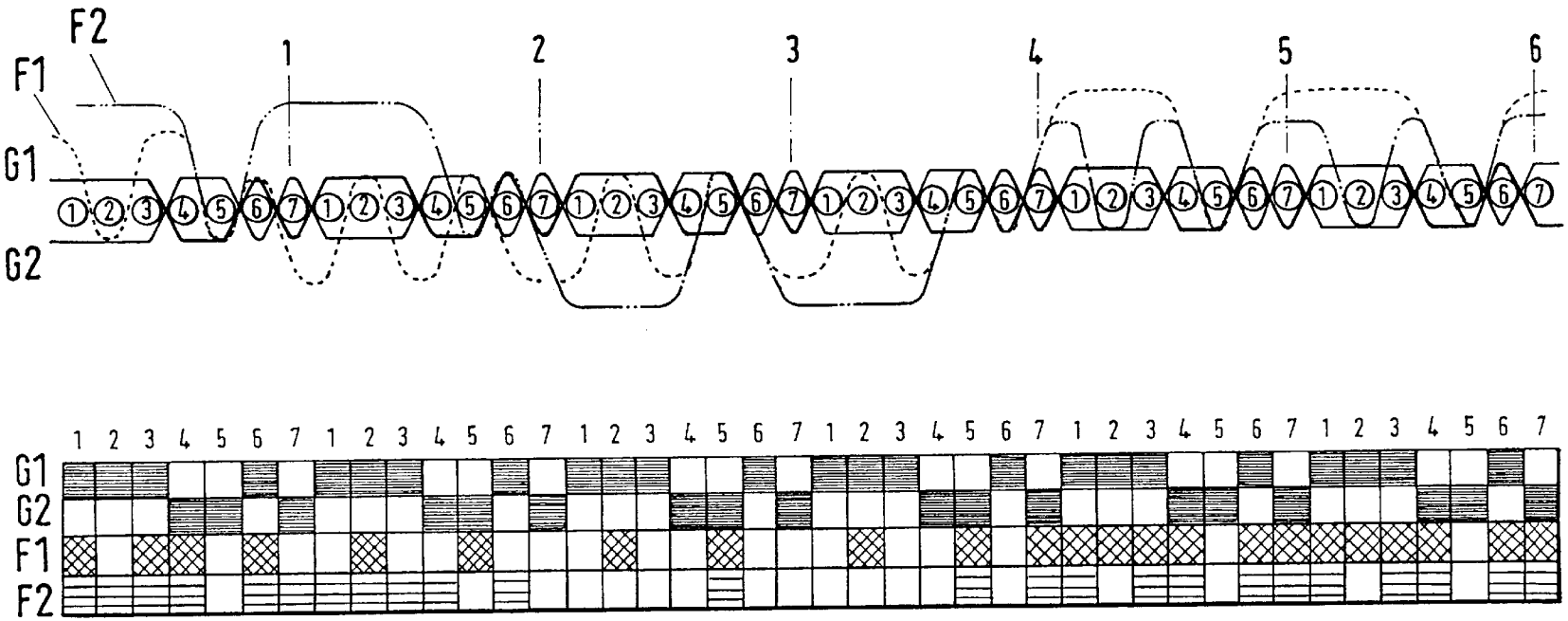
FIG. 8 is a section of the of FIG. 2*a*, with a fourth pile pattern and the float repeat for the fabric.

FIG. 5 shows a seven-weft terry fabric with alternately formed loops, as can be recognized from the dotted line for F1 and the chain dotted line for F2. With such terry fabrics the pile threads alternate from one side of the fabric to the other side of the fabric. For this purpose binding changes are provided and indeed a Burkhart-Vossen binding change BV or a four-weft binding change VS. It can be seen from the representation that a BV binding change is provided in the first weft group and a four-weft binding change is provided in the second weft group. FIG. 6 illustrates a further pile pattern for a seven-weft terry fabric which is executed with the same basic binding of the example of FIG. 5. The FIGS. 7*a* and 7*b* show embodiments of basic float repeats for the seven-weft terry fiabric FIG. 8 shows a seven-weft terry fabric with an example of a pile pattern from which the diversity of the pile binding and further advantages are evident, with, for example, some sections only having loops above the fabric and other sections only having loops beneath the fabric.

Figure 9:
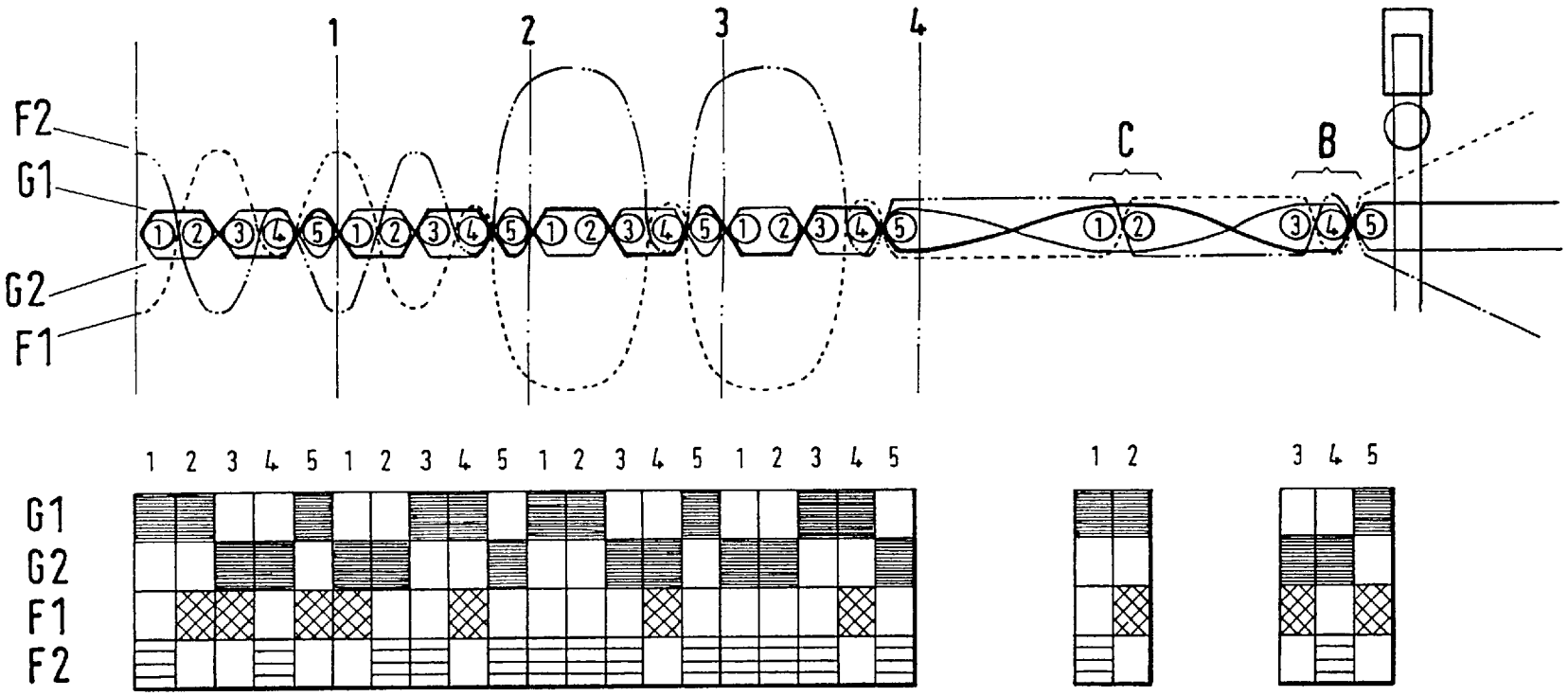
FIG. 9 is a section of a second embodiment of a in accordance with the invention and the float repeat for the fabric.
Figure 10A:
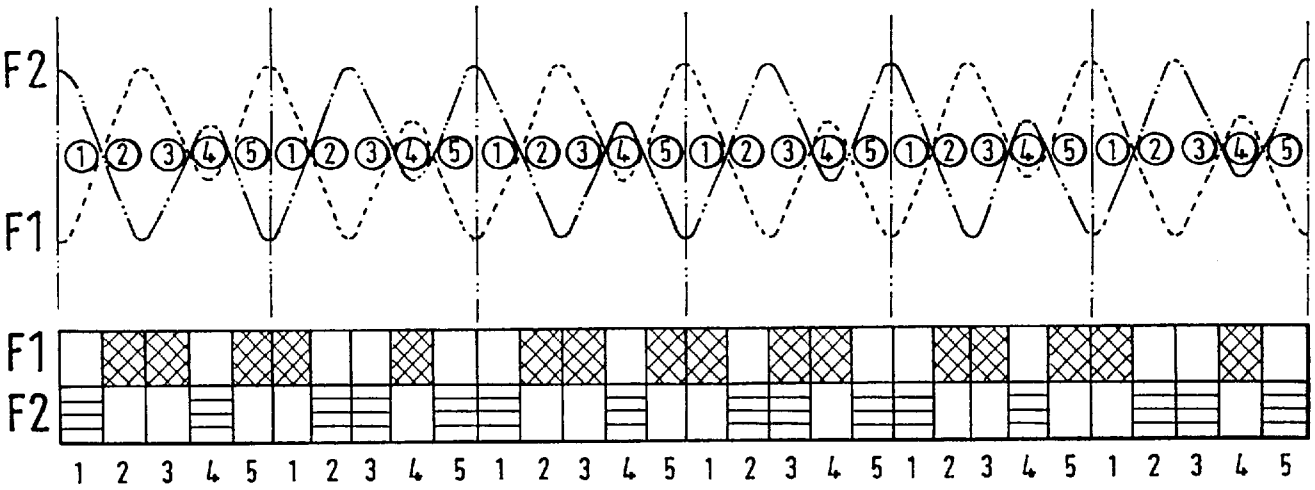
FIGS. 10*a* and *b* show first embodiments of pile patterns for a fabric in accordance with FIG. 9 and the float repeat for the pile warp.
Figure 10B:
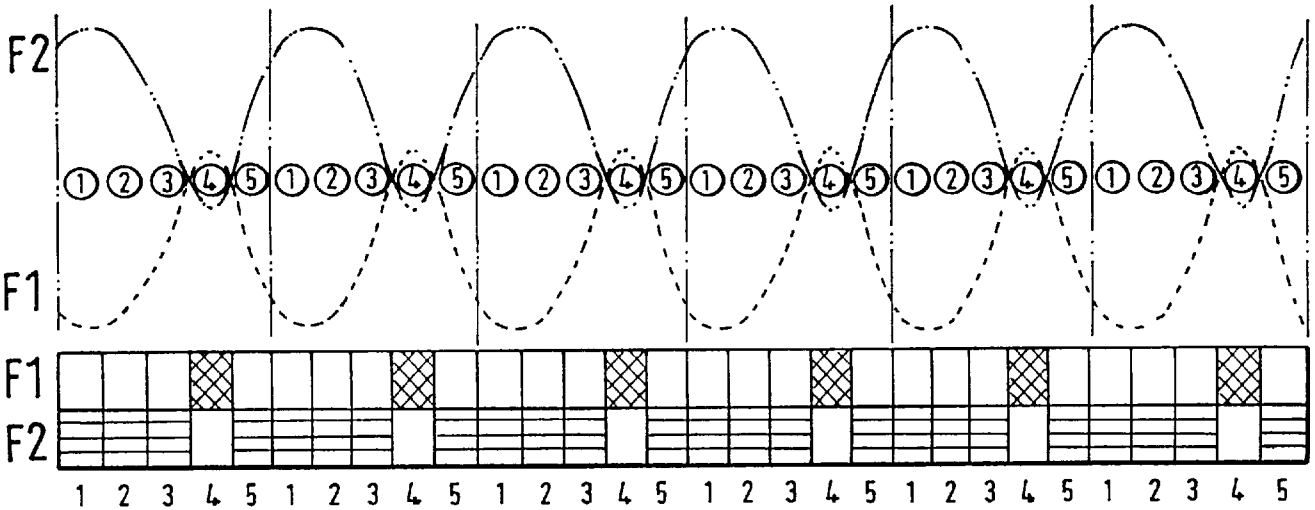

Reference is made to FIG. 9. The fabric comprises basic warp threads G1 and G2, weft threads and pile warp threads F1 and F2, which have the same or different colours. The fabric is a double-sided five-weft terry fabric with differing loops. This fabric is based on a ten-weft float repeat and a five-weft beat-up repeat. In the first partially beaten up group C the pile warp threads change in a BV binding change to the other side of the fabric. In the second partially beaten up group B the pile warp threads are bound in, without a loop change to the opposite side taking place.

In this fabric the float repeat each includes two weft beat-up repeats. The two weft beat-up repeats each include a first weft group C, which contains two partly beaten up wefts 1, 2, and a second weft group B, which contains two partly beaten up wefts 3, 4 and one fully beaten up weft 5.

Figure 11A:
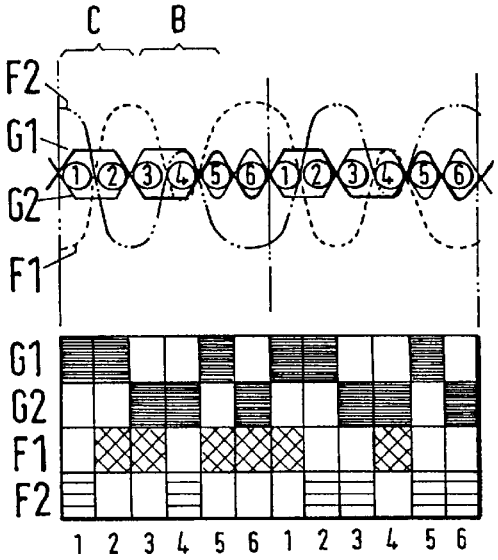
FIGS. 11*a,b,c,d* are pictures of a third embodiment of a fabric in accordance with the invention and the float repeat for the fabric.
Figure 11B:
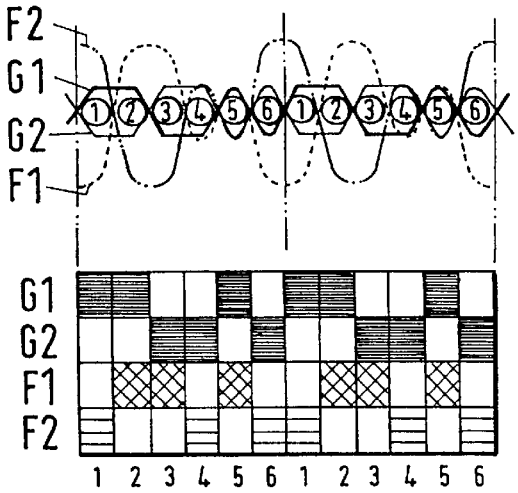
Figure 11C:
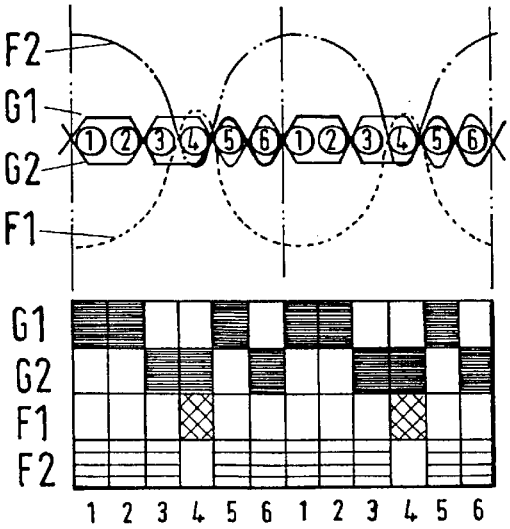
Figure 11D:
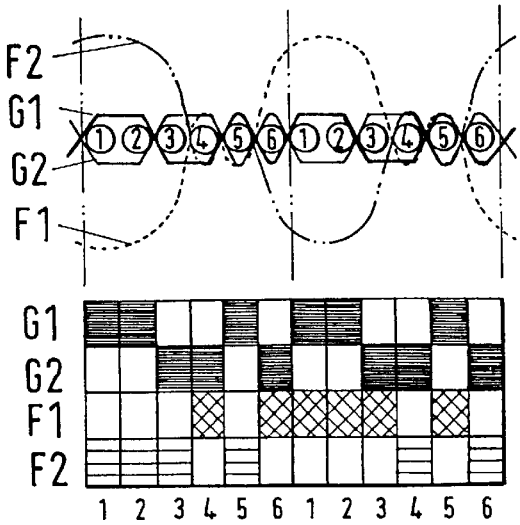

The FIGS. 11*a* and 11*b* each show further examples of pile patterns for five-weft terry fabrics, with these drawings only showing the pile bindings.

Reference is made to FIGS. 11*a* to 11*d*. The fabric is a six-weft terry fabric, which is based on a float report consisting of six wefts and a weft beat-up repeat, with the float repeat in the examples of FIGS. 11*b* and 11*c* each comprising two weft beat-up repeats. In this fabric the float repeat and the weft beat-up repeat each include a first-weft group C, which contains two partially beaten up wefts 1, 2, a second weft group B, which contains two partially beaten up wefts 3, 4 and one fully beaten up weft 5 and a smooth weft 6. The advantage of this binding is to be seen in that the pile threads, which change in the second partially beaten up group from one side of the fabric to the other side of the fabric, are executed by means of a four-weft binding change.

The terry fabric comprises a basic warp, weft threads and a pile warp or loop warp. The terry fabric is based on a float repeat or weft beat-up repeat, which includes a first and a second weft group. Whereas the first weft group in each case contains partially beaten up wefts, the second weft group contains in each case one fully beaten up weft or additionally a smooth weft.

What is claimed is:

1. Terry fabric with relief effect, the fabric being formed from a basic warp, weft threads and at least one pile warp or loop warp and being based on a previously determined float repeat and weft beat-up repeat, wherein first and second weft groups are provided and are jointly beaten up, each weft group having at least three weft threads, wherein the weft beat-up repeat and the float repeat further include an additional weft which is bound off in the basic warp and is fully beaten up.

2. Terry fabric in accordance with claim 1, wherein the first weft group comprises two partially beaten up wefts and the second weft group comprises two partially beaten up wefts and one fully beaten up weft.

3. Terry fabric in accordance with claim 1, wherein the first weft group comprises three partially beaten up wefts and the second weft group comprises two partially beaten up wefts and one fully beaten up weft.

4. Terry fabric in accordance with claim 1, wherein the repeat contains a plurality of additional fully beaten up wefts, which are bound off individually or jointly in the basic warp.

5. Terry fabric in accordance with claim 1, wherein the float repeat includes three weft groups.

6. Terry fabric in accordance with claim 1, wherein the float repeat of the basic warp and/or of the pile warp are combined into partial groups and are beaten up at a cloth edge.

7. Terry fabric in accordance with claim 1, wherein the loops are formed at at least one side of the fabric.

8. Terry fabric in accordance with claim 1, wherein the loops are altematively formed at sides of the fabric.

9. Terry fabric in accordance with claim 1, wherein a BV binding change is provided in the float repeat in the first weft group and a four-weft binding change is provided in the second weft group.

10. Terry fabric with relief effect, the fabric being formed from a basic warp, weft threads and at least one pile warp or loop warp, and being based on a previously determined float repeat and weft beat-up repeat, wherein first and second weft groups are provided and are jointly beaten up, the float repeat and/or the weft beat-up repeat including an odd number of more than three wefts.

11. Terry fabric in accordance with claim 10, wherein the float repeat and the weft beat-up repeat include five wefts.

12. Terry fabric in accordance with claim 10, wherein the float repeat and the weft beat-up repeat include seven wefts.

13. Terry fabric in accordance with claim 12, wherein the first weft group comprises three partly beaten up wefts and the second weft group comprises three partly beaten up wefts and one fully beaten up weft.

14. Terry fabric in accordance with claim 11, wherein the first weft group comprises two partly beaten up wefts and the second weft group comprises two partly beaten up wefts and one fully beaten up weft.

15. A method of producing a terry fabric with relief effect, the fabric being formed from a basic warp, weft threads and at least one pile warp or loop warp and being based on a previously determined float repeat and weft beat-up repeat comprising providing and jointly beating up first and second weft groups, each weft group comprising at least three weft threads, and providing and beating up an additional fully beaten up weft which is bound off in the basic warp.

16. Method for the manufacture of a terry fabric in accordance with claim 15, wherein at least either one of the float repeat and the weft beat-up repeat includes an odd number of wefts, and the odd number of wefts are woven in after one another in the first and second weft groups and are jointly beaten up.

17. Method in accordance with claim 16, wherein after the beating up of the weft groups at a cloth edge an additional fully beaten up weft is inserted and likewise beaten up at the cloth edge and bound off in the basic warp.

18. Method in accordance with claim 17, wherein the weft groups are respectively woven in relative to one another and relative to the cloth edge so that a loop pair with the same height is formed.

* * * * *